US007315012B2

(12) United States Patent
Hisamatsu et al.

(10) Patent No.: US 7,315,012 B2
(45) Date of Patent: Jan. 1, 2008

(54) MICROWAVE BAKING FURNACE

(75) Inventors: Yoshihiro Hisamatsu, Tochigi (JP); Eiji Nomura, Tochigi (JP); Kazuhiko Tachikawa, Tochigi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/100,466

(22) Filed: Apr. 7, 2005

(65) Prior Publication Data

US 2005/0236410 A1 Oct. 27, 2005

(30) Foreign Application Priority Data

Apr. 7, 2004 (JP) ..... P. 2004-112856

(51) Int. Cl.
*H05B 6/64* (2006.01)

(52) U.S. Cl. ..... 219/757; 219/756

(58) Field of Classification Search ..... 219/757, 219/756, 678, 758

See application file for complete search history.

(56) References Cited

U.S. PATENT DOCUMENTS 6,494,130 B2 * 12/2002 Brown ..... 99/324
6,528,773 B2 * 3/2003 Kim et al. ..... 219/681
6,578,569 B2 * 6/2003 Liese ..... 126/299 R
6,608,292 B1 * 8/2003 Barnes ..... 219/730
6,689,996 B2 * 2/2004 Shon et al. ..... 219/707
6,712,063 B1 * 3/2004 Thorneywork ..... 126/21 A
6,723,970 B1 * 4/2004 Whipple, Jr. ..... 219/681
6,761,159 B1 * 7/2004 Barnes et al. ..... 126/21 R
6,772,752 B1 * 8/2004 Boyer ..... 126/21 A

FOREIGN PATENT DOCUMENTS

JP 55-118588 A 9/1980
JP 2002-130960 5/2002
JP 2003-277157 A 10/2003

* cited by examiner

*Primary Examiner*—Daniel Robinson
(74) *Attorney, Agent, or Firm*—McDermott Will & Emery LLP

(57) ABSTRACT

To provide a microwave baking furnace in which an inner wall which constitutes a heating element partitioning a baking chamber is prevented from being damaged due to a thermal shock, and the life time thereof can be extended.

A microwave baking furnace 31 includes a partition wall 35 of a heating element 33 which partitions a baking chamber and which has an inner wall 35*b* made of a material self-heating by microwave radiation and transmitting part of microwaves radiated thereto, and an outer wall 35*a* made of an insulating material permitting the microwaves to be transmitted therethrough and covering an outer circumference of the inner wall 35*b*. A clearance 39, which serves as a convection path of heat inside the baking chamber 23, is secured between the inner wall 35*a* and the outer wall 35*a*. The inner wall 35*b* is attached to the outer wall 35*a* such that it can move relative to the outer wall 35*a* by a predetermined distance in all directions.

4 Claims, 5 Drawing Sheets

MICROWAVE BAKING FURNACE

BACKGROUND OF THE INVENTION

1. Field of the Invention

The present invention relates to a microwave baking furnace for baking an object to be baked which is made of a pottery material or a fine ceramics material.

2. Description of the Related Art

Recently, a technique in which the pottery material and the fine ceramics are baked by microwave heating is suggested, and this technique has already been put to practical use.

When an object to be baked is baked by the microwave heating, and the object to be baked is homogeneous, the microwave uniformly heats each part of the object to be baked in principle. However, since an atmosphere temperature is considerably lower than a surface temperature of the object to be baked at the beginning of a baking process, heat is radiated from the surface of the object to be baked. As a result, a temperature gradient occurs between a central portion of the object to be baked and the surface thereof and crack easily occurs.

Further, when an object to be baked is made of the same material, as characteristics of the microwave heating, dielectric loss becomes larger as temperature rises up. Therefore, if the temperature gradient occurs, a microwave absorption rate of a high-temperature portion is high, the difference in microwave absorption rate is further progressed, and local heating occurs partially.

When the temperature gradient occurs in this way, the difference in temperature further increases due to the microwave heating. As a result, the occurrence of the crack is assisted.

Further, in the baking using the microwave heating, in case that an object to be baked is made of a material such as alumina or silica, which is a main material of ceramics and has a low dielectric loss at room temperature, there is a problem in that the energy efficiency of microwave heating in a low-temperature zone is low.

Therefore, as the microwave baking furnace for suppressing such a temperature gradient and for reducing the occurrence of the crack, a microwave baking furnace having the structure shown in FIG. 5 is suggested (for example, refer to Japanese Unexamined Patent Application Publication No. 2002-130960 (Page 3, FIG. 1)).

A microwave baking furnace 1 includes a cavity 3 partitioning a microwave space 2, a magnetron 6 as a microwave generating means which is connected to the cavity 3 via a waveguide 4 and radiates microwave to the inside of the cavity 3, a microwave stirring means 8 for stirring the microwave radiated to the inside of the cavity, a blanket 10 arranged inside the cavity 3, and an auxiliary blanket 11 surrounding the blanket 10.

The cavity 3 reflects the microwave toward the microwave space 2 at least at the inside thereof and prevents the microwave from leaking.

The microwave stirring means 8 has stirring blades 14 disposed inside the cavity 3, a driving motor 16 disposed outside the cavity 3, a rotation transmitting shaft 18 for transmitting the rotation of the driving motor 16 to the stirring blades 14. The atmosphere in the cavity 3 is stirred by the rotation of the stirring blades 14.

The blanket 10 partitions a baking chamber 23 in which an object to be baked is disposed. A partition wall 25 partitioning the baking chamber 23 is constructed as a double wall structure of an outer wall 25*a* and an inner wall 25*b*.

The outer wall 25*a* is made of a material which has insulating properties and permits the microwaves to be transmitted therethrough. Specifically, the outer wall 25*a* is made of alumina fiber or foamed alumina.

The inner wall 25*b* is made of a dielectric material which self-heats by the microwave radiated thereto from the outside and which can transmit part of the microwaves to the inside of the baking chamber 23.

As a preferred dielectric material for the inner wall 25*b*, for example, a heating material for a high-temperature zone, which self-heats equally to or more than an object to be baked in a high-temperature zone near a baking temperature. In case that the object to be baked is pottery, a mullite-based material is preferable.

The auxiliary blanket 11 makes the periphery of the blanket 10 an insulating space and suppresses the occurrence of a temperature gradient due to the heat radiation from the blanket 10 to the surrounding atmosphere thereof. Therefore, the auxiliary blanket 11 is made of an insulating material such as alumina fiber or foamed alumina, which has insulating properties and permits microwaves to be transmitted therethrough, similar to the outer wall 25*a* of the blanket 10.

As described above, when the partition wall 25 of the blanket 10, which partitions the baking chamber 23, is comprised of the inner wall 25*b* capable of transmitting part of microwaves to the inside of the baking chamber 23 while self-heating by the microwave, and the outer wall 25*a* which is made of an insulating material and surrounds the inner wall, the atmosphere temperature inside the baking chamber 23 rises by the self-heating of the inner wall 25*b* and the heat radiation from the baking chamber 23 to the outside is suppressed by the outer wall 25*a*, simultaneously with the progress of the microwave heating to an object to be baked.

Therefore, the atmosphere inside the baking chamber 23 is kept stable at a high temperature according to the temperature rising of the object 21 to be baked so that the heat radiation from the surface of the object 21 to be baked to the periphery thereof can be suppressed.

As a result, a temperature gradient between the central portion of the object to be baked and the surface thereof hardly occurs, and crack is prevented from occurring due to the temperature gradient. Thus, the baking can be performed stably.

However, in the conventional partition wall 25, the outer wall 25*a* for the main purpose of insulation and the inner wall 25*b* for the main purpose of heating constitute a double wall structure in a state in which they are closely adhered to each other. Therefore, when the temperature of the inner wall 25*b* rises to a high-temperature zone at a time or the inner wall is cooled down after baking, a significant thermal shock acts between the outer wall 25*a* and the inner wall 25*b* due to the difference in thermal expansion therebetween. As a result, the inner wall 25*b* made of, for example, a mullite-based material may be easily broken, and the life span of the double wall structure for preventing the occurrence of the temperature gradient may be shortened.

Further, the mullite-based material used for the inner wall 25*b* shows high heating characteristics near the baking temperature of the object 21 to be baked, but shows low heating characteristics in a low-temperature zone including room temperature. Therefore, at the time of initial temperature rising in a low-temperature zone by the microwave heating, the self-heating value of the inner wall 25*b* is small.

Thus, a problem remains unsolved that when an object to be baked whose dielectric loss is small at room temperature is baked, it is difficult to efficiently heat the object to be baked, similar to the conventional baking furnace.

SUMMARY OF THE INVENTION

An object of the present invention is to provide a microwave baking furnace capable of reliably preventing the occurrence of a temperature gradient in a baking chamber for a long time by extending the life span of a partition wall having a double wall structure without damaging an inner wall constituting a partition wall due to a thermal shock, in a partition wall partitioning the baking chamber and having the double wall structure of the inner wall and the outer wall. Further, another object of the present invention is to provide a microwave baking furnace capable of efficiently realizing the temperature rising in a low-temperature zone and a high-temperature zone only by microwave heating, and of efficiently baking an object to be baked even when the object to be baked whose dielectric loss is small at room temperature is baked.

The structure of the present invention to achieve the above-mentioned objects is as follows.

(1) In a first aspect of the present invention, there is provided a microwave baking furnace including an inner wall which partitions a baking chamber and transmit part of microwaves while self-heating by microwave radiation, and an outer wall which is made of an insulating material permitting the microwave to be transmitted therethrough and covers an outer circumference of the inner wall. A clearance which serves as a convection path of heat inside the baking chamber is secured between the inner wall partitioning the baking chamber and the outer wall. The inner wall is attached to the outer wall such that it can move relative to the outer wall by a predetermined distance in all directions.

(2) In a second aspect according to the first aspect of the present invention, there is provided a microwave heating furnace in which the inner wall is made of a heating material for a high-temperature zone which self-heats in the high-temperature zone which becomes a baking temperature by the microwave radiation. Further, auxiliary heating elements, which are made of a heating material for a low-temperature zone which transmits part of microwaves while self-heating in the low-temperature zone including room temperature by microwave radiation, are buried in the outer wall.

(3) In a third aspect according to the second aspect of the present invention, there is provided a microwave heating furnace, in which the heating material for the low-temperature zone gives a greater heating value than that of the heating material for the high-temperature zone from low-temperature zone including room temperature to a lower temperature than the high-temperature zone which becomes the baking temperature, and gives a heating value equal to or less than that of the heating material for the high-temperature zone in a high-temperature zone which becomes the baking temperature.

(4) In a fourth aspect according to the second aspect or the third aspect of the present invention, there is provided a microwave heating furnace in which the auxiliary heating elements are buried in the outer wall within a range corresponding to a central region of the inner wall.

In the partition wall partitioning the baking chamber and having the double wall structure of the inner wall and the outer wall, a clearance, which serves as a heat convection path inside the baking chamber, is secured between the outer wall and the inner wall, so that the difference in temperature between the outer wall and the inner wall is reduced by the convection flowing through the clearance. Further, since the inner wall can move relatively by a predetermined distance in all directions, the outer wall and the inner wall are free from mutual constraint caused by their thermal expansion, and a thermal shock to the outer wall and inner wall can be reduced at the time of temperature rising by microwave heating.

Therefore, the inner wall is free from breakage caused by the thermal shock, and it is possible to reliably prevent the occurrence of a temperature gradient in a baking chamber for a long time by extending the life span of a partition wall of a double wall structure.

DESCRIPTION OF THE PREFERRED EMBODIMENTS

Figure 1:
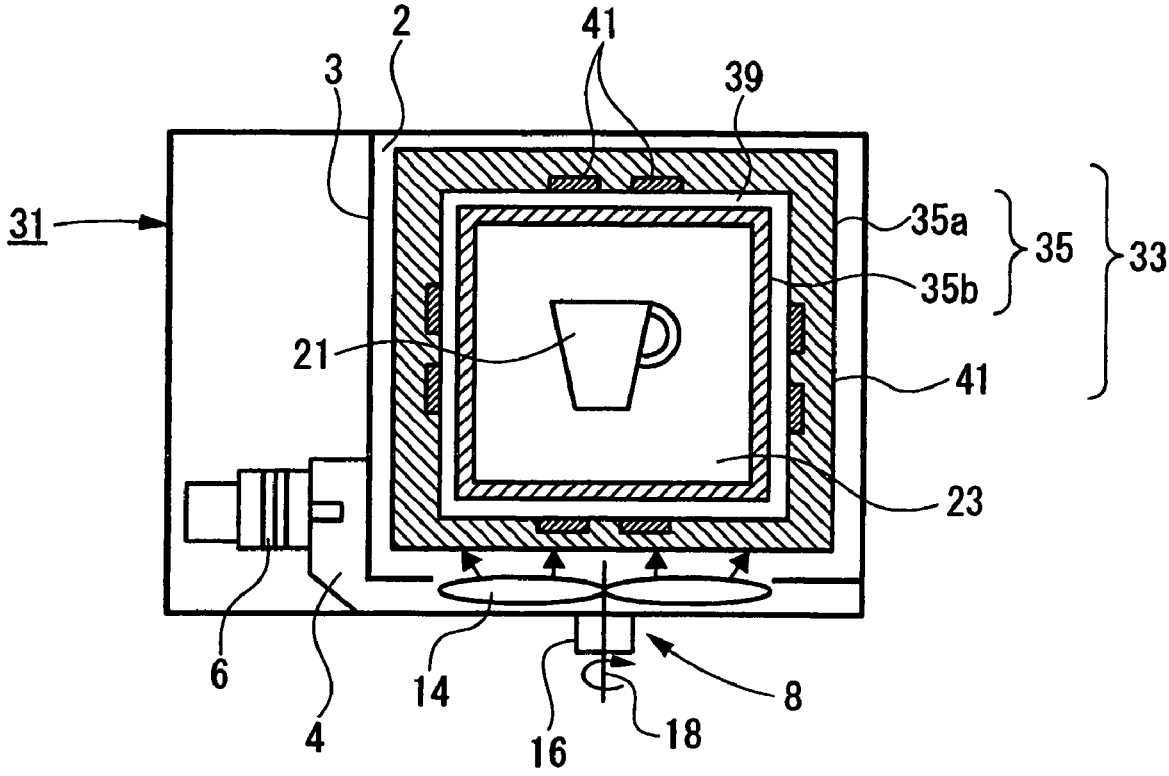
FIG. 1 is a schematic view illustrating a microwave baking furnace according to an embodiment of the present invention.

Hereinafter, a preferred embodiment of a microwave baking furnace according to the present invention will be described in detail with reference to the attached drawings FIG. 1 illustrates a microwave baking furnace according to an embodiment of the present invention.

A microwave baking furnace 31 in this embodiment bakes an object 21 to be baked made of a material such as a pottery material and fine ceramics with microwave heating. The microwave baking furnace 31 includes a cavity 3 partitioning a microwave space 2, a magnetron 6 as a microwave generating means which is connected to the cavity 3 via a waveguide 4 and radiates a microwave to the inside of the cavity 3, a microwave stirring means 8 for stirring the microwave irradiated to the inside of the cavity 3, and a heating element 33 which is placed in the cavity 3 and will be described later.

The cavity 3 reflects the microwave to the microwave space 2 at least at the inside thereof and prevents the microwave from leaking.

The microwave stirring means 8 comprises stirring blades 14 arranged inside the cavity 3, a driving motor 16 arranged outside the cavity 3, a rotation transmitting shaft 18 for transmitting the rotation of the driving motor 16 to the stirring blades 14. The atmosphere inside the cavity 3 is stirred by the rotation of the stirring blades 14.

The heating element 33 forms a baking chamber 23 in which an object 21 to be baked is placed, and self-heats to heat the object 21 to be baked such that a partition wall 35 partitioning the baking chamber 23 is constructed as a two-layer structure of an outer wall 35*a* and an inner wall 35*b*.

The outer wall 35*a* is made of a material such as alumina fiber or foamed alumina, which has heat-insulating properties and permits the microwaves to be transmitted therethrough.

As the thickness of the outer wall 35*a* becomes large, heat radiation from the baking chamber 23 or the heating element 33 toward the outside thereof can be suppressed.

The inner wall 35*b* is made of a dielectric material which self-heats by the microwave radiated from the outside, and can transmit part of the radiated microwaves to the object 21 to be baked disposed inside the baking chamber 23.

More specifically, the inner wall 35*b* is made of a heat generating material for a high-temperature zone which self-heats in the high-temperature zone which becomes principally a baking temperature by the microwave radiation.

Here, as the generating material for the high-temperature zone, it is needed that a heating value per unit volume by the microwave heating is larger than that of the object 21 to be baked. Specifically, a mullite-based material, a silicon nitride-based material, alumina, etc. can be exemplified as the heating material. The heating material having an appropriate heating value is selected depending on the temperature characteristics of the object 21 to be baked.

Further, as the heating material for the high-temperature zone, it is preferable that metal oxide having a large microwave absorption rate (for example, magnesia, zirconia, iron oxide, etc.), or an inorganic material (for example, silicon carbide) is added to the above-described heating material with a small amount to adjust the heating characteristics.

Figure 2:
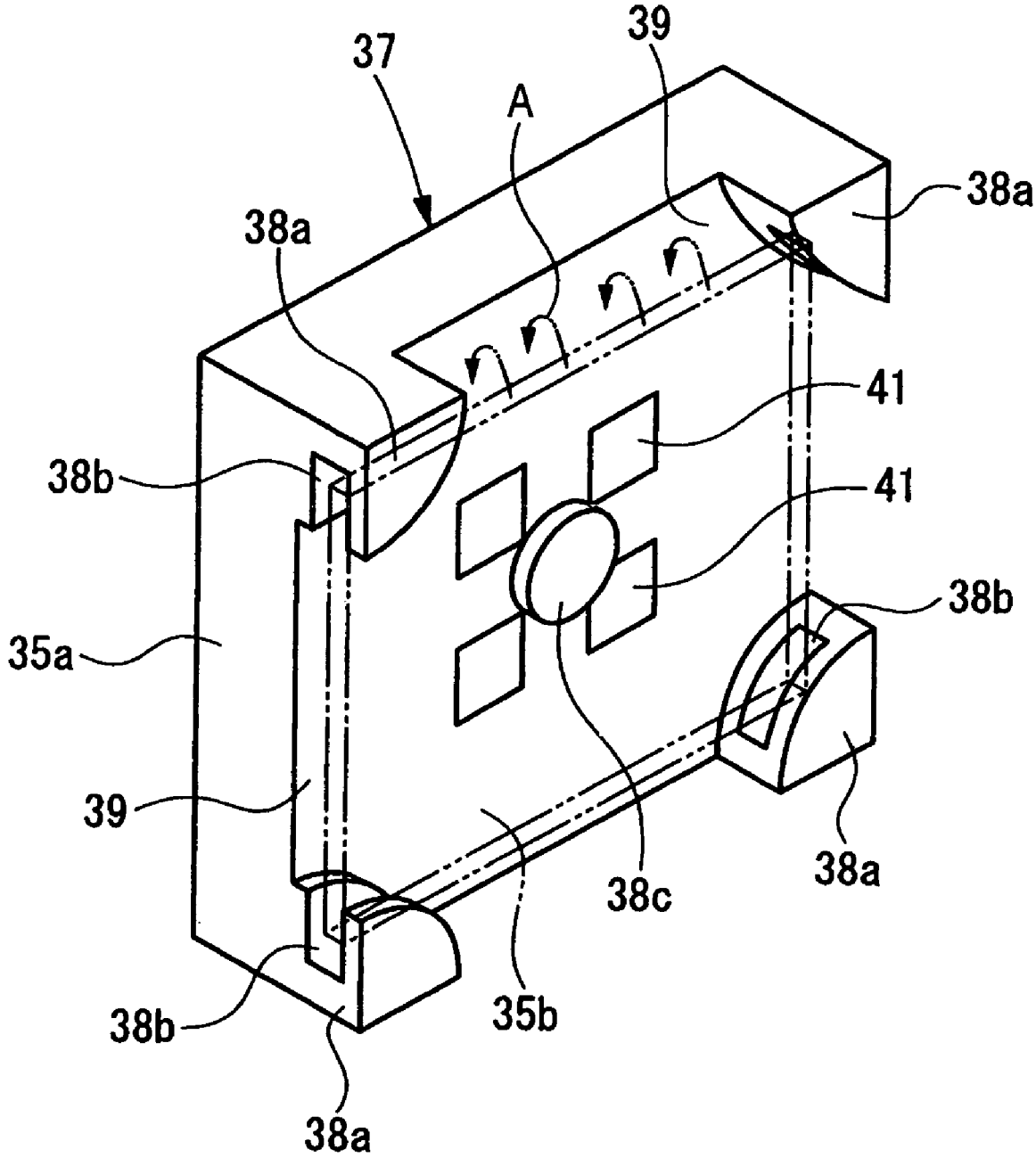
FIG. 2 is a perspective view illustrating a connection structure between an outer wall and an inner wall of a partition wall of a heating element shown in FIG. 1.

In the present embodiment, in the partition wall 35 of the heating element 33, each of a top face, a bottom face, a front face, a rear face, a left face, and a right face, which partitions the baking chamber 23, is comprised of a partition wall unit 37 shown in FIG. 2. The respective faces are detachably assembled to each other.

Figure 3:
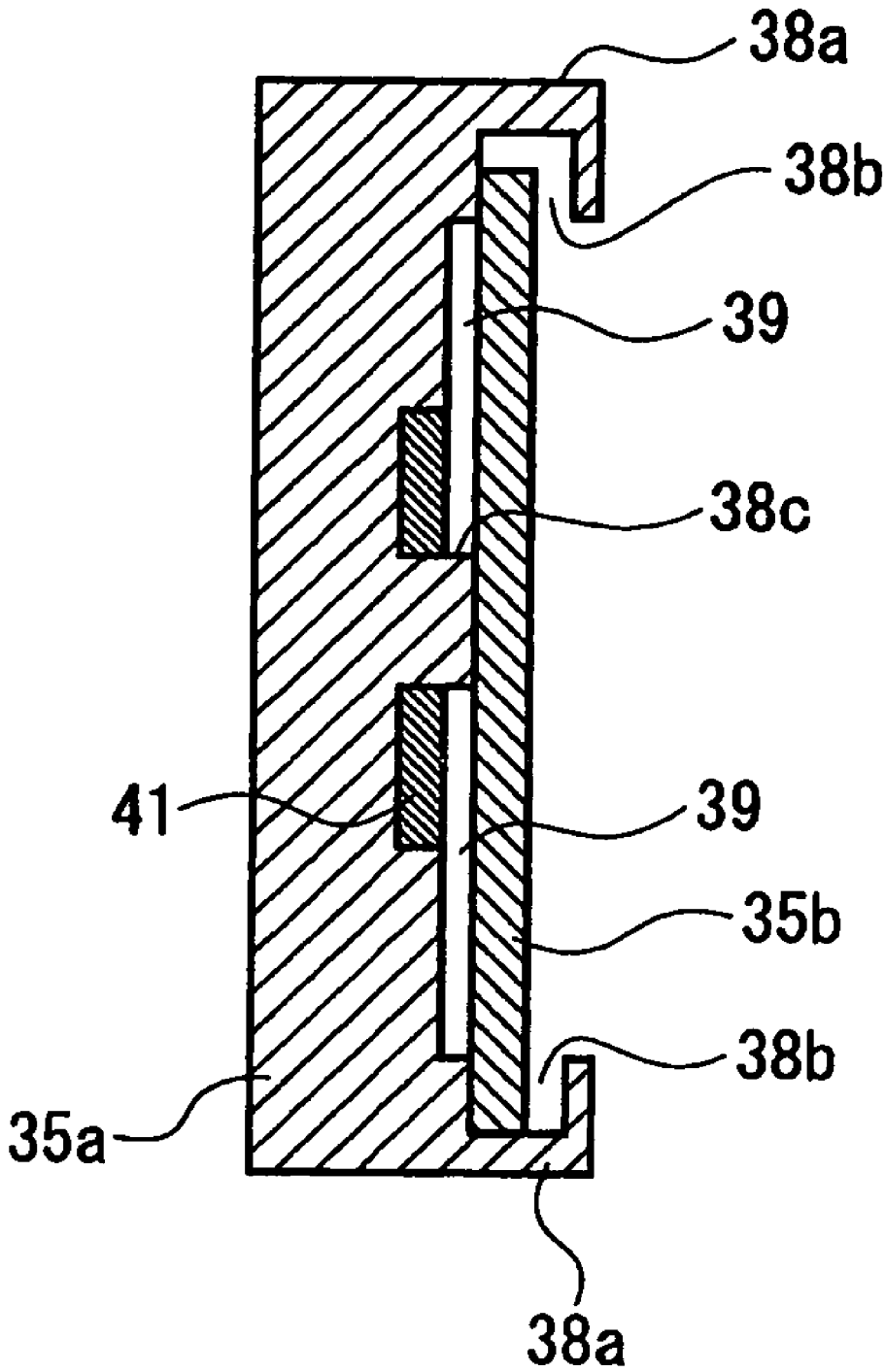
FIG. 3 is a sectional view taken along a line III—III of FIG. 2.

As shown in FIGS. 2 and 3, the partition wall 37 is constructed as a double wall structure of the outer wall 35*a* and the inner wall 35*b*, in which the thin flat plate-shaped inner wall 35*b* is attached to the inner side of the thick flat plate-shaped outer wall 35*a*.

The outer wall 35*a* is constructed such that holding grooves 38*b* having peripheral edges of the inner wall 35*b* fitted thereinto are formed at braces 38*a* protruding from four corners thereof.

In the holding groove 38*b* formed at each of the braces 38*a*, the installation position is set such that a clearance 39 which becomes a convection path of heat inside the baking chamber 23 is secured between the outer wall 35*a* and the inner wall 35*b*.

As indicated by an arrow (A) in FIG. 2, a heat flow inside the baking chamber 23 flows into the convection path formed by the clearance 39 from an opening formed in the outer circumference of the inner wall 35*b* to eliminate the difference in temperature inside the clearance 39.

Further, the depth or width of the holding grooves 38*b* is set such that the inner wall 35*b* can move relative to the outer wall 35*a* covering the outer side of the inner wall 35*b* by a predetermined distance in all directions (including a face direction and a thickness direction of the plate).

That is, the unit 37 according to the present embodiment is attached such that the clearance 39 which becomes a convection path of heat inside the baking chamber is secured between the outer wall 35*a* and the inner wall 35*b*, and each inner wall 35*b* can move relative to the outer wall 35*a* covering the outer side thereof by a predetermined distance in all directions.

Further, auxiliary heating elements 41 made of a material for a low-temperature zone, which self-heats in a zone of a low temperature including, principally, room temperature by microwave radiation and transmits part of the microwaves radiated thereto, is buried in the outer wall 35*a*.

Furthermore, a position restriction protrusion 38*c*, which prevents a central portion of the inner wall 35*b* from being flexed and contacting the outer wall 35*a*, protrudes from the central portion of the outer wall 35*a*.

The position restriction protrusion 38*c* serves as a spacer which prevents the central portion of the inner wall 35*b* being flexed and contacting the auxiliary heating elements 41 and secures the clearance 39 between the outer wall 35*a* and the inner wall 35*b*.

As a heating material for a low-temperature zone, which is used as the auxiliary heating elements 41, a dielectric material is used. The dielectric material shows a heating value larger than that of a heating material for a high temperature such as a mullite-based material which is used for the inner wall 35*b*, from the low-temperature zone including room temperature to a temperature less than the high-temperature zone which becomes a baking temperature, and shows a heating value equal to or less than that of the heating material for high-temperature zone in the high-temperature zone which becomes the baking temperature.

Specifically, as the heating material for the low-temperature zone which is used for the auxiliary heating elements 41, a material having superior microwave absorption properties is used. At room temperature, such a material shows a heating value per unit volume by the microwave, which is from several times to several tens times that of a material constituting the object 21 to be baked, and in a high-temperature zone which becomes a baking temperature, shows a heating value equal to or less than that of the heating material for a high-temperature zone. Specifically, magnesia, zirconia, iron oxide, silicon carbide, etc. can be exemplified.

In the case of the present embodiment, the auxiliary heating elements 41 are buried in an inner surface of the outer wall 35*a* within a range corresponding to a central portion of the inner wall 35*b*, as a small-sized chip having a spherical or rectangular parallelepiped shape.

Figure 4:
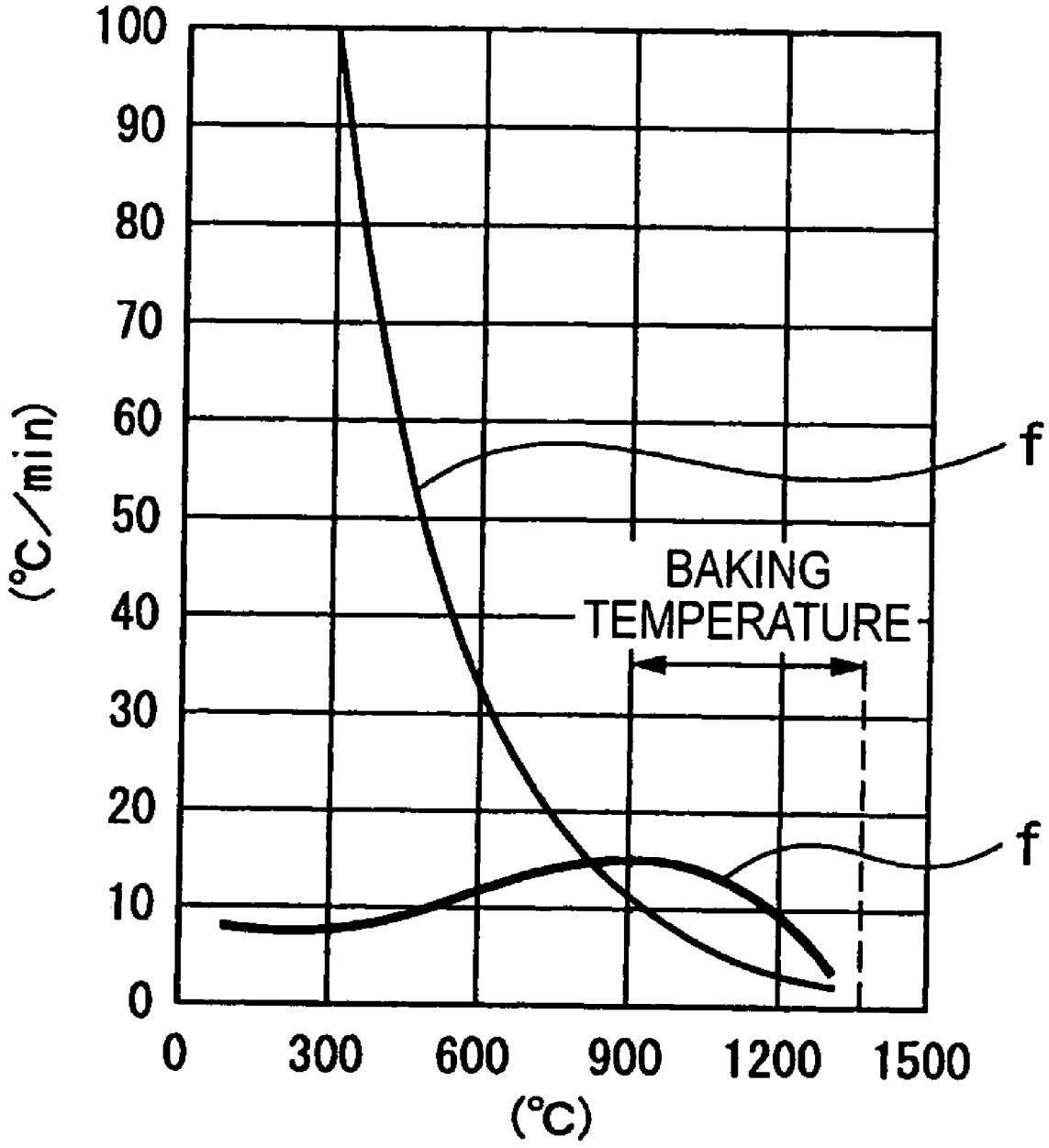
FIG. 4 is a graph showing temperature-rising characteristics by the microwave heating of the inner wall and auxiliary heating elements used in the microwave baking furnace according to the embodiment of the present invention.
Figure 5:
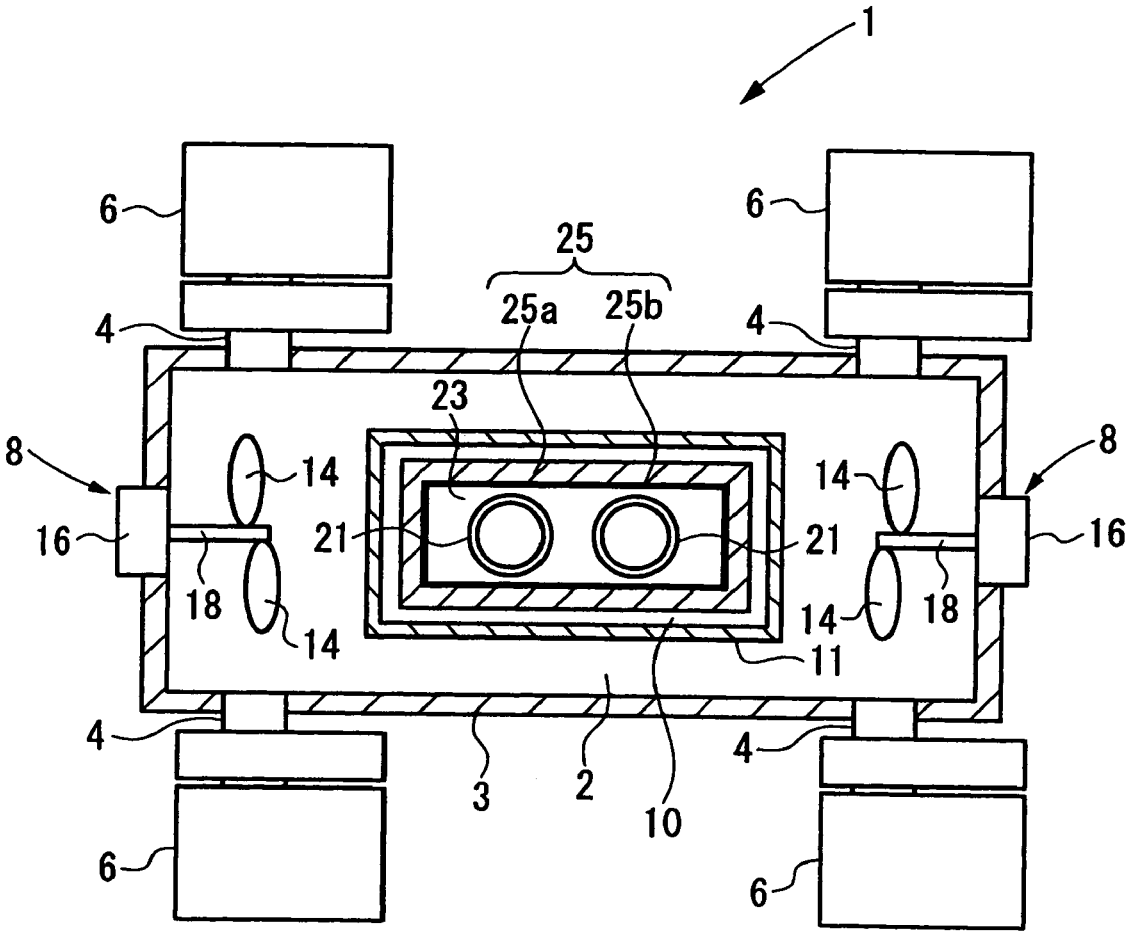
FIG. 5 is a schematic view illustrating a conventional microwave baking furnace.

FIG. 4 illustrates the relationship between a heating temperature of the inner wall 35*b* and the auxiliary heating elements 41 and a rising temperature per unit time in heating by a microwave. In FIG. 4, a curved line f1 represents the relationship between the heating temperature and the rising temperature per unit time in a case in which a mullite-based material is used as a heating material for a high-temperature zone. Further, a curved line f2 represents the relationship between the heating temperature and the rising temperature per unit time in a case in which silicon carbide is used as a heating material for a low-temperature zone.

According to the above-described microwave baking furnace 31, when the microwave is radiated to the heating element 33 from the magnetron 6 which is a microwave generating means, the heating element 33 rises in temperature by the microwave heating, and, at the same time, the object to be baked positioned inside the baking chamber 23 rises in temperature by the microwave transmitted through the heating element 33.

During such a baking process, the temperature inside the baking chamber 23 rises by the self-heating of the inner wall 35*b* concurrently with the progress of the microwave heating of the object 21 to be baked, and heat radiation from the baking chamber 23 and the inner wall 35*b* toward the outside can be suppressed by the outer wall 35*a* having superior insulating properties.

Therefore, since the atmosphere inside the baking chamber 23 is kept stable at a high temperature according to the rising in temperature of the object 21 to be baked, the heat radiation from the surface of the object 21 to be baked toward the surrounding atmosphere thereof can be suppressed.

As a result, a temperature gradient between the central portion of the object to be baked and the surface thereof hardly occurs and crack is prevented from occurring due to the temperature gradient. Thus, the baking can be stably performed.

Further, in the partition wall 35 having a double wall structure of the heating element 33 partitioning the baking chamber 23, the clearance 39, which serves as a heat convection path inside the baking chamber 23, is secured between the outer wall 35*a* and the inner wall 35*b* so that the difference in temperature between the outer wall 35*a* and the inner wall 35*b* is reduced by the convection flowing through the clearance 39. Further, since the inner wall 35*b* can move relatively in all directions, the outer wall 35*a* and the inner wall 35*b* are free from mutual constraint caused by their thermal expansion, and a thermal shock to the outer wall 35*a* and inner wall 35*b* can be reduced at the time of temperature rising by the microwave heating.

Therefore, the inner wall 35*b* is free from damage caused by the thermal shock, and it is possible to reliably prevent the occurrence of the temperature gradient in the baking chamber 23 for a long time by extending the life span of the partition wall 35 having a double wall structure.

Further, at the time of the temperature rising of the low-temperature zone by the microwave heating during the above-described baking process, the auxiliary heating elements 41, which are made of a heating material for a low-temperature zone and are buried in the outer wall 35*a* of the partition wall 35 of the heating element 33, heat with a high degree of energy efficiency and accelerate the rise in the ambient temperature. Therefore, when the microwave proceeds and the temperature of the partition wall 35 of the heating element 33 rises to the predetermined high-temperature zone, the heating material for a high-temperature zone which forms the inner wall 35*b* heats with a high heating efficiency and raises the ambient temperature.

Therefore, it is possible to efficiently realize the temperature rising of the low-temperature zone and the high-temperature zone only by the microwave heating. For example, even in a case in which the object 21 to be baked is made of a material such as alumina or silica, which is a main material of ceramics whose dielectric loss is small at room temperature, it is possible to bake it smoothly with a high degree of energy efficiency.

Further, since the temperature rising of the low-temperature zone and the high-temperature zone is performed with a high degree of energy efficiency by the heating material for low-temperature zone and the heating material for high-temperature zone, the ambient temperature rises stably from the low-temperature zone to the high-temperature zone by the heat radiation from the heating material for the low-temperature zone or the heating material for the high-temperature zone, the temperature of atmosphere inside the baking chamber, which is partitioned by the heating element 33, and the microwave space outside the heating element 33 rises similarly to that of the object 21 to be baked, and the difference in temperature between the object 21 to be baked and the surrounding atmosphere can be suppressed.

Therefore, the heat radiation of the object 21 to be baked from the low-temperature zone to the high-temperature zone can be suppressed, and the temperature gradient between the surface and an inner deep portion of the object 21 to be baked can be prevented from occurring.

As a result, it is possible to prevent crack from occurring due to the temperature gradient and to perform the high-quality baking process.

Further, in the microwave baking furnace 31 according to the present embodiment, as a heating material for a low-temperature zone, which is used as the auxiliary heating elements 41, a dielectric material is used. The dielectric material shows a heating value larger than that of a heating material for a high temperature zone such as a mullite-based material which is used as the inner wall 35*b*, from a low-temperature zone including room temperature to a temperature zone less than the high-temperature zone which becomes a baking temperature, and shows a heating value equal to or less than that of the heating material for high-temperature zone in the high-temperature zone which becomes the baking temperature. Therefore, it is possible to perform a temperature control in which the rising rate of temperature in the low-temperature zone and the rising rate of temperature in the high-temperature zone during the microwave heating are suppressed within a stable temperature-rising width with a small variation. Further, it is possible to perform a stable baking process with a high degree of energy efficiency from the high-temperature zone to the low-temperature zone and to realize the baking process with high precision in which crack is prevented from occurring.

Further, in the microwave baking furnace 31 according to the present embodiment, since the auxiliary heating elements 41 are buried in the outer wall 35*a* within a range corresponding to the central region of the inner wall 35*b*, the heating of the inner wall 35*b* by the auxiliary heating elements 41 made of a heating material for a low-temperature zone is focused on the central portion of the inner wall 35*b* and it does not affect the periphery of the inner wall 35*b* in which local thermal deformation may be easily caused.

Specifically, the inner wall 35*b* disperses the thermal expansion caused by heating of the auxiliary heating elements 41 to a range of the central region so that it is possible to prevent large thermal deformation from being caused locally at the peripheral portion supported by the outer wall 35*a* and to prevent the breakage of the inner wall 35*b* caused by the rapid deformation at the peripheral portion. Therefore, the life span of the inner wall 35*b* can be extended.

Further, the connection structure of the outer wall 35*a* and the inner wall 35*b* to secure the clearance between the outer wall 35*a* and the inner wall 35*b*, and the structure for supporting the inner wall 35*b* such that it can move by a predetermined distance in all directions are not limited to the structure illustrated in the above-described embodiment.

What is claimed is:

1. A microwave baking furnace, comprising:

an inner wall, partitioning a baking chamber and transmitting part of microwaves while self-heating by microwave radiation; and an outer wall, made of an insulating material permitting the microwaves to be transmitted therethrough and covering an outer circumference of the inner wall;

wherein a clearance which serves as a convection path of heat inside the baking chamber is secured between the inner wall partitioning the baking chamber and the outer wall; and the inner wall is attached to the outer wall such that it can move relative to the outer wall by a predetermined distance in all directions while microwaves are being transmitted in the baking furnace.

2. The microwave baking furnace according to claim 1, wherein the inner wall is made of a heating material for a high-temperature zone which self-heats in the high-temperature zone which becomes a baking temperature by the microwave radiation; and auxiliary heating elements, which are made of a heating material for a low-temperature zone which transmits part of microwaves while self-heating in the low-temperature zone including room temperature by the microwave radiation, are buried in the outer wall.

3. The microwave baking furnace according to claim 2, wherein the heating material for the low-temperature zone gives a greater heating value than that of the heating material for the high-temperature zone from the low-temperature zone including room temperature to a lower temperature than the high-temperature zone which becomes the baking temperature, and gives a heating value equal to or less than that of the heating material for the high-temperature zone in a high-temperature zone which becomes the baking temperature.

4. The microwave baking furnace according to claim 2 or 3, wherein the auxiliary heating elements are buried in the outer wall within a range corresponding to a central region of the inner wall.

* * * * *